US006772583B2

(12) United States Patent
Bland

(10) Patent No.: US 6,772,583 B2
(45) Date of Patent: Aug. 10, 2004

(54) CAN COMBUSTOR FOR A GAS TURBINE ENGINE

(75) Inventor: Robert Bland, Ovideo, FL (US)

(73) Assignee: Siemens Westinghouse Power Corporation, Orlando, FL (US)

( * ) Notice: Subject to any disclaimer, the term of this patent is extended or adjusted under 35 U.S.C. 154(b) by 21 days.

(21) Appl. No.: 10/241,296

(22) Filed: Sep. 11, 2002

(65) Prior Publication Data

US 2004/0045273 A1 Mar. 11, 2004

(51) Int. Cl.[7] ..... F02C 3/00
(52) U.S. Cl. ..... 60/39.37; 60/746
(58) Field of Search ..... 60/39.37, 748, 60/746

(56) References Cited

U.S. PATENT DOCUMENTS

| | | | | |
|---|---|---|---|---|
| 3,153,323 A | * | 10/1964 | Hamm | 60/737 |
| 3,763,650 A | | 10/1973 | Hussey et al. | |
| 3,938,324 A | | 2/1976 | Hammond, Jr. et al. | |
| 4,100,733 A | | 7/1978 | Striebel et al. | |
| 4,265,085 A | | 5/1981 | Fox et al. | |
| 4,417,439 A | | 11/1983 | Sepulveda et al. | |
| 4,928,481 A | | 5/1990 | Joshi et al. | |
| 4,991,398 A | * | 2/1991 | Clark et al. | 60/748 |
| 5,095,696 A | | 3/1992 | Gulati et al. | |
| 5,307,621 A | | 5/1994 | Glassman et al. | |
| 5,353,599 A | | 10/1994 | Johnson et al. | |
| 5,372,008 A | | 12/1994 | Sood | |
| 5,400,587 A | | 3/1995 | Keller et al. | |
| 5,402,634 A | * | 4/1995 | Marshall | 60/776 |
| 5,491,970 A | | 2/1996 | Davis, Jr. et al. | |
| 5,551,228 A | | 9/1996 | Mick et al. | |
| 5,623,826 A | | 4/1997 | Ohtsuka et al. | |
| 5,685,139 A | | 11/1997 | Mick et al. | |
| 5,974,781 A | | 11/1999 | Correa et al. | |
| 5,983,643 A | | 11/1999 | Kiesow | |
| 6,082,111 A | | 7/2000 | Stokes | |
| 6,119,459 A | | 9/2000 | Gomez et al. | |
| 6,145,297 A | | 11/2000 | Nagafuchi et al. | |
| 6,189,314 B1 | | 2/2001 | Yamamoto et al. | |

FOREIGN PATENT DOCUMENTS

JP 411344224 A 12/1999

* cited by examiner

*Primary Examiner*—Charles G. Freay

(57) ABSTRACT

A gas turbine engine (10) includes a plurality of can combustors (19). Each can combustor includes a first stage of burners (46) located at a first radius about the combustor centerline (42) and a second stage of burners (50) located at a second radius greater than the first radius. The second stage of burners may be clocked to an angular position that is not midway between respective neighboring burners of the first stage. Combustion instabilities may be controlled by exploiting variations in combustion parameters created by differential fueling of the two stages.

18 Claims, 3 Drawing Sheets

CAN COMBUSTOR FOR A GAS TURBINE ENGINE

FIELD OF THE INVENTION

This invention relates to the field of gas turbine engines and, in particular, to gas turbine engines having a can annular combustor.

BACKGROUND OF THE INVENTION

Gas turbine engines are known to include a compressor for compressing air; a combustor for producing a hot gas by burning fuel in the presence of the compressed air produced by the compressor, and a turbine for expanding the hot gas to extract shaft power. The combustion process in many older gas turbine engines is dominated by diffusion flames burning at or near stoichiometric conditions with flame temperatures exceeding 3,000° F. Such combustion will produce a high level of oxides of nitrogen (NOx). Current emissions regulations have greatly reduced the allowable levels of NOx emissions. Lean premixed combustion has been developed to reduce the peak flame temperatures and to correspondingly reduce the production of NOx in gas turbine engines. In a premixed combustion process, fuel and air are premixed in a premixing section of the combustor. The fuel-air mixture is then introduced into a combustion chamber where it is burned. U.S. Pat. No. 6,082,111 describes a gas turbine engine utilizing a can annular premix combustor design. Multiple premixers are positioned in a ring to provide a premixed fuel/air mixture to a combustion chamber. A pilot fuel nozzle is located at the center of the ring to provide a flow of pilot fuel to the combustion chamber.

The design of a gas turbine combustor is complicated by the necessity for the gas turbine engine to operate reliably with a low level of emissions at a variety of power levels. High power operation at high firing temperatures tends to increase the generation of oxides of nitrogen. Low power operation at lower combustion temperatures tends to increase the generation of carbon monoxide and unburned hydrocarbons due to incomplete combustion of the fuel. Under all operating conditions, it is important to ensure the stability of the flame to avoid unexpected flameout, damaging levels of acoustic vibration, and damaging flashback of the flame from the combustion chamber into the fuel premix section of the combustor. A relatively rich fuel/air mixture will improve the stability of the combustion process but will have an adverse affect on the level of emissions. A careful balance must be achieved among these various constraints in order to provide a reliable machine capable of satisfying very strict modern emissions regulations.

Dynamics concerns vary among the different types of combustor designs. Gas turbines having an annular combustion chamber include a plurality of burners disposed in one or more concentric rings for providing fuel into a single toroidal annulus. U.S. Pat. No. 5,400,587 describes one such annular combustion chamber design. Annular combustion chamber dynamics are generally dominated by circumferential pressure pulsation modes between the plurality of burners. In contrast, gas turbines having can annular combustion chambers include a plurality of individual can combustors wherein the combustion process in each can is relatively isolated from interaction with the combustion process of adjacent cans. Can annular combustion chamber dynamics are generally dominated by axial pressure pulsation modes within the individual cans.

Staging is the delivery of fuel to the combustion chamber through at least two separately controllable fuel supply systems or stages including separate fuel nozzles or sets of fuel nozzles. As the power level of the machine is increased, the amount of fuel supplied through each stage is increased to achieve a desired power level. A two-stage can annular combustor is described in U.S. Pat. No. 4,265,085. The combustor of the '085 patent includes a primary stage delivering fuel to a central region of the combustion chamber and a secondary stage delivering fuel to an annular region of the combustion chamber surrounding the central region. The primary stage is a fuel-rich core wherein stoichiometry can be optimized. U.S. Pat. No. 5,974,781 describes an axially staged hybrid can-annular combustor wherein the premixers for two stages are positioned at different axial locations along the axial flow path of the combustion air. U.S. Pat. No. 5,307,621 describes a method of controlling combustion using an asymmetric whirl combustion pattern.

SUMMARY OF THE INVENTION

With the continuing demand for gas turbine engines having lower levels of emissions and increased operational flexibility, further improvements in gas turbine combustor design and operation are needed. Accordingly, a can combustor for a gas turbine engine is described herein as including: a first stage comprising a first plurality of burners arranged symmetrically around a longitudinal centerline of a combustion chamber at a first radial distance from the centerline; and a second stage comprising a second plurality of burners arranged symmetrically around the centerline of the combustion chamber at a second radial distance different than the first radial distance. The burners of the second stage may be angularly positioned midway between respective neighboring burners of the first stage or at respective angular locations other than midway between respective neighboring burners of the first stage.

A can combustor for a gas turbine engine is further describe as including: a first stage comprising a first plurality of burners arranged symmetrically around a longitudinal centerline of a combustion chamber and angularly separated from each other by an angle of 360/N degrees; a second stage comprising a second plurality of burners arranged symmetrically around the longitudinal centerline of the combustion chamber and angularly separated from each other by an angle of 360/N degrees; wherein the burners of the second stage are positioned at respective angular locations other than midway between respective neighboring burners of the first stage. The first plurality of burners may be spaced from the longitudinal centerline at a first radial distance; and the second plurality of burners may be spaced from the longitudinal centerline at a second radial distance different than the first radial distance.

A gas turbine engine is described as including: a compressor for supplying compressed air; a can annular combustor for burning fuel in the compressed air to produce a hot gas; and a turbine for expanding the hot gas; wherein the can annular combustor further comprises a plurality of can combustors each comprising: an annular member defining a combustion chamber having a longitudinal centerline; a first plurality of burners disposed in a symmetrical ring around the centerline at a first radial distance; and a second plurality of burners disposed in a symmetrical ring around the centerline at a second radial distance greater than the first radial distance. The angular position of the second plurality of burners may be selected so that the burners of the second plurality of burners are angularly centered between respective neighboring burners of the first plurality of burners or so that the burners of the second plurality of burners are not angularly centered between respective neighboring burners of the first plurality of burners.

A gas turbine engine is describe herein as including: a compressor for supplying compressed air; a can annular combustor for burning fuel in the compressed air to produce a hot gas; and a turbine for expanding the hot gas; wherein the can annular combustor further comprises a plurality of can combustors each comprising: a first stage of burners disposed in a symmetrical circular pattern about a centerline, N being the number of burners in the first stage of burners and 360/N° being an angle of separation between burners of the first stage of burners; a second stage of burners disposed in a symmetrical circular pattern about the centerline, the burners of the second stage of burners being singularly disposed between respective neighboring burners of the first stage of burners, N being the number of burners in the second stage of burners and 360/N° being an angle of separation between burners of the second stage of burners; and an angular separation between burners of the first stage of burners and neighboring burners of the second stage of burners being an angle not equal to 360/2N°. The first stage of burners may be disposed in a circular pattern having a first radius about the centerline; and the second stage of burners may be disposed in a circular pattern having a second radius about the centerline not equal to the first radius.

BRIEF DESCRIPTION OF THE DRAWINGS

These and other advantages of the invention will be more apparent from the following description in view of the drawings that show.

DETAILED DESCRIPTION OF THE INVENTION

Figure 1:
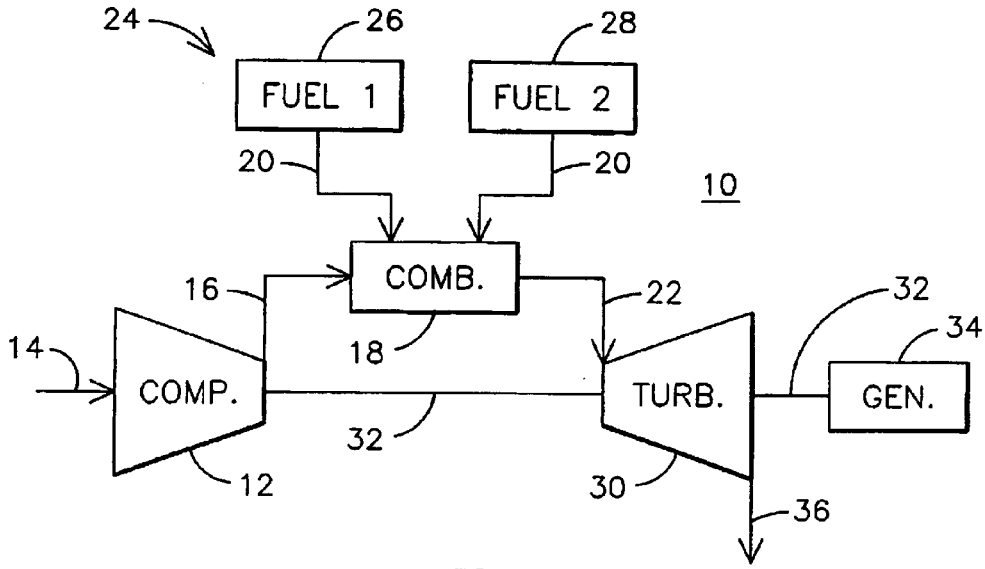
FIG. 1 is a functional diagram of a gas turbine engine having an improved can annular combustor design.

FIG. 1 illustrates a gas turbine engine 10 having a compressor 12 for receiving a flow of filtered ambient air 14 and for producing a flow of compressed air 16. The compressed air 16 is received by a combustor 18 of the can annular type where it is used to burn a flow of a combustible fuel 20, such as natural gas or fuel oil for example, to produce a flow of hot combustion gas 22. The fuel 20 is supplied by a fuel supply apparatus 24 capable of providing two independently controllable stages of fuel flow from a first stage fuel supply 26 and a second stage fuel supply 28. The hot combustion gas 22 is received by a turbine 30 where it is expanded to extract mechanical shaft power. In one embodiment, a common shaft 32 interconnects the turbine 30 with the compressor 12 as well as an electrical generator 34 to provide mechanical power for compressing the ambient air 14 and for producing electrical power, respectively. The expanded combustion gas 36 may be exhausted directly to the atmosphere or it may be routed through additional heat recovery systems (not shown).

Figure 2:
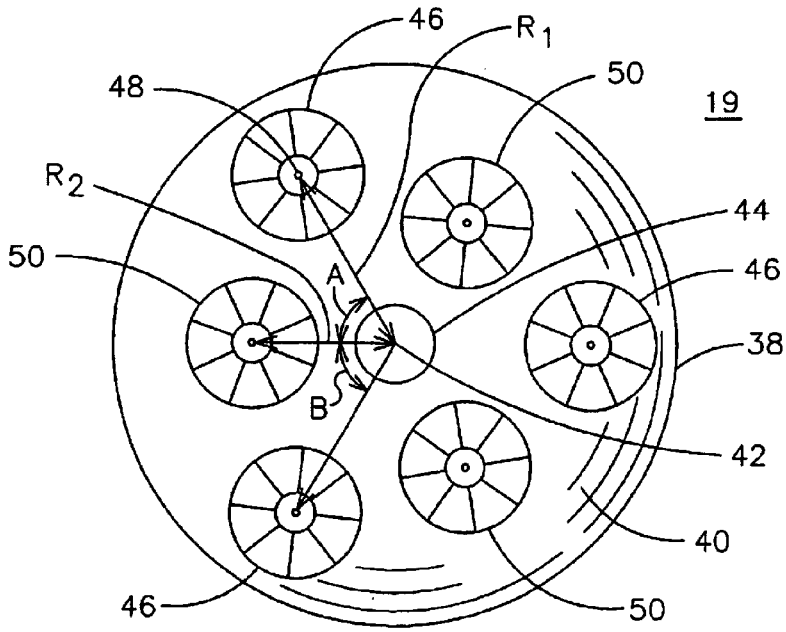
FIG. 2 is a sectional view of the can annular combustor of the gas turbine engine of FIG. 1.

The gas turbine engine 10 provides improved operating flexibility as a result of features of the combustor 18 that are shown more clearly in FIG. 2. FIG. 2 is a partial sectional view of just one of the can combustors 19 contained within the can annular combustor 18. FIG. 2 illustrates a section taken perpendicular to the direction of flow of the hot combustion gas 22 through the can combustor 19. Combustor can 19 includes an annular member 38 extending from a base plate 39 and defining a combustion chamber 40 having a longitudinal centerline 42. A pilot burner 44 may be located at the centerline location, although such a pilot burner may not be used for all applications. Combustor 18 also includes a first plurality of burners 46 disposed in a symmetrical ring at a first radial distance $R_1$ around the centerline 42. The distance $R_1$ is measured from the longitudinal centerline 42 of the combustion chamber 40 to the centerline 48 of the respective burner 46. The centers of all of the first plurality of burners 46 are located on a circle having a radius of $R_1$ about the centerline 42. Can combustor 19 also includes a second plurality of burners 50 disposed in a symmetrical ring around the centerline 42 at a second radial distance $R_2$. $R_2$ may be equal to or greater than the first radial distance $R_1$ as will be described more fully below. Burners 46, 50 may be any design known in the art and are preferably premix burners. The first plurality of burners 46 is connected to the first stage fuel supply 26 and the second plurality of burners 50 is connected to the second stage fuel supply 28 to form a two-stage burner. It is also possible to divide the six burners into three or more fuel stages to provide additional degrees of control flexibility, although it is recognized that additional fuel stages may be expensive and would generally not be used unless necessary. Furthermore, the number of fuel stages should be no more than the number of burners divided by 2 or the combustion will become asymmetric. If provided, the pilot burner 44 may be connected to a separate pilot fuel supply (not shown). The pilot burner 44 may be a premix or diffusion burner.

The number N of burners in the first plurality of burners 46 as well as in the second plurality of burners 50 is illustrated as being three, although other arrangements are possible. N=2, 3 or 4 are probably the only practical applications in a can annular application. Because the arrangement of the burners about the centerline is symmetric, the separation between burners of the first plurality of burners 46 as well as the separation between burners of the second plurality of burners 50 is 360/N°, or in the illustrated embodiment 360/3° or 120 degrees. If the clocking between the first plurality of burners 46 and the second plurality of burners 50 is selected so that neighboring burners are equidistant from each other, the angular separation between neighboring burners 46, 50 is 360/2N° or 60 degrees. Alternatively, the relative clocking between the two stages of burners 46, 50 may be selected so that an angular separation between burners of the first plurality of burners 46 and neighboring burners of the second plurality of burners 50 is an angle not equal to 360/2N°.

Figure 3A:
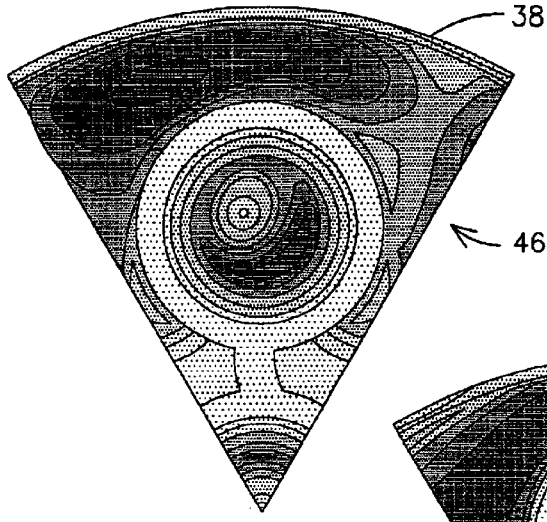
FIG. 3A is a calculated temperature field for a burner of the can annular combustor of FIG. 2 with a first radial location.
Figure 3B:
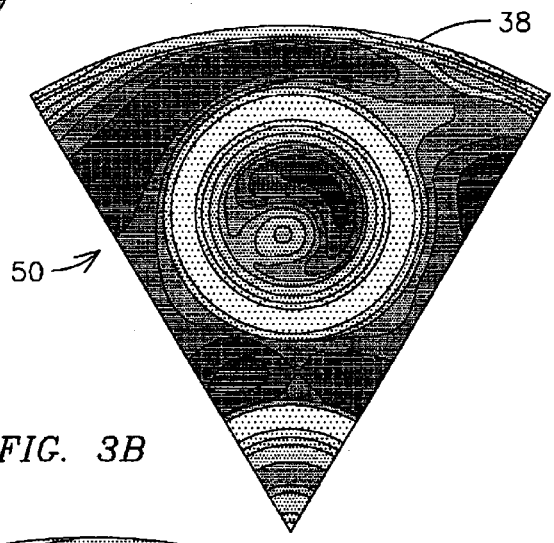
FIG. 3B is a calculated temperature field for a burner of the can annular combustor of FIG. 2 with a second radial location.
Figure 3C:
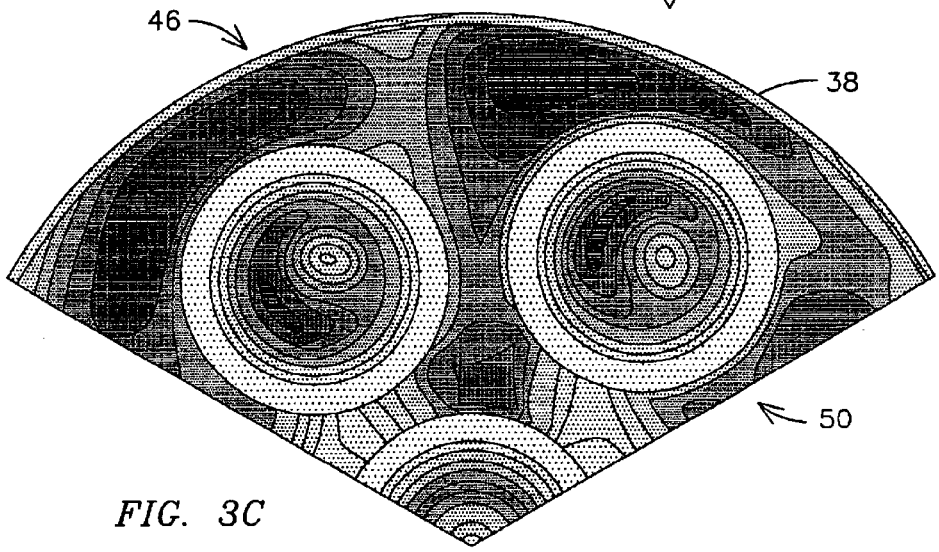
FIG. 3C is a calculated temperature field for a neighboring pair of burners of the can annular combustor of FIG. 2.

It is desired to provide a symmetrical arrangement of burners within the can combustor 19, and prior art can combustors exhibit such symmetry. However, a symmetrical arrangement of burners will produce a homogeneous flame front that may be vulnerable to combustion instability at a resonant frequency. The present invention provides an increased degree of control over the combustion process to address the possibility of such instability without the addition of special burners and without the need for an additional fuel stage. FIG. 2 illustrates that can combustor 19 has its first stage burners 46 disposed at a different radius $R_1$ than the radius $R_2$ of the second stage burners 50. As a result of this difference, the two stages having essentially identical fuel supplies and burner designs will produce somewhat different combustion conditions within the combustion chamber 40. FIGS. 3A–3C illustrate these differences and how these differences may be used to control the combustion process to avoid instabilities.

FIG. 3A illustrates a calculated temperature of the hot combustion gas 22 across a plane located just downstream from burner 46 located at a distance $R_1$ away from centerline 42. The darkness of the shading in this figure correlates to the temperature. The results of a similar calculation for a burner 50 under the same firing conditions but located at a distance $R_2$ away from centerline 42 are illustrated in FIG. 3B. In this example, $R_2$ is greater than $R_1$. The same shading represents the same temperature in each of these Figures. A comparison of FIG. 3A to FIG. 3B reveals that the distance of the burner from the centerline 42 affects the temperature distribution within the combustion chamber 40. FIG. 3C illustrates the temperature distribution that will result when firing both of two neighboring burners 46, 50 located at respective dissimilar radii of $R_1$ and $R_2$. One may appreciate that this temperature distribution will change as the relative fuel flow rates are changed between the burners 46, 50. The combustion in combustion chamber 40 will remain symmetrical about the centerline 42 regardless of whether only the first stage 46 is fueled, or if only the second stage 50 is fueled, or if both the first and second stages 46, 50 are fueled. However, the temperature distributions of FIGS. 3A, 3B and 3C reveal that there is a difference in the combustion process among these three fueling configurations, and that difference can be exploited as a degree of control over the combustion process to optimize one or more combustion parameters under various operating conditions. This differs from prior art can combustors wherein the burners of all stages are located at the same radial distance and wherein all stages respond identically to changes in the rate of fuel delivery.

Figure 4:
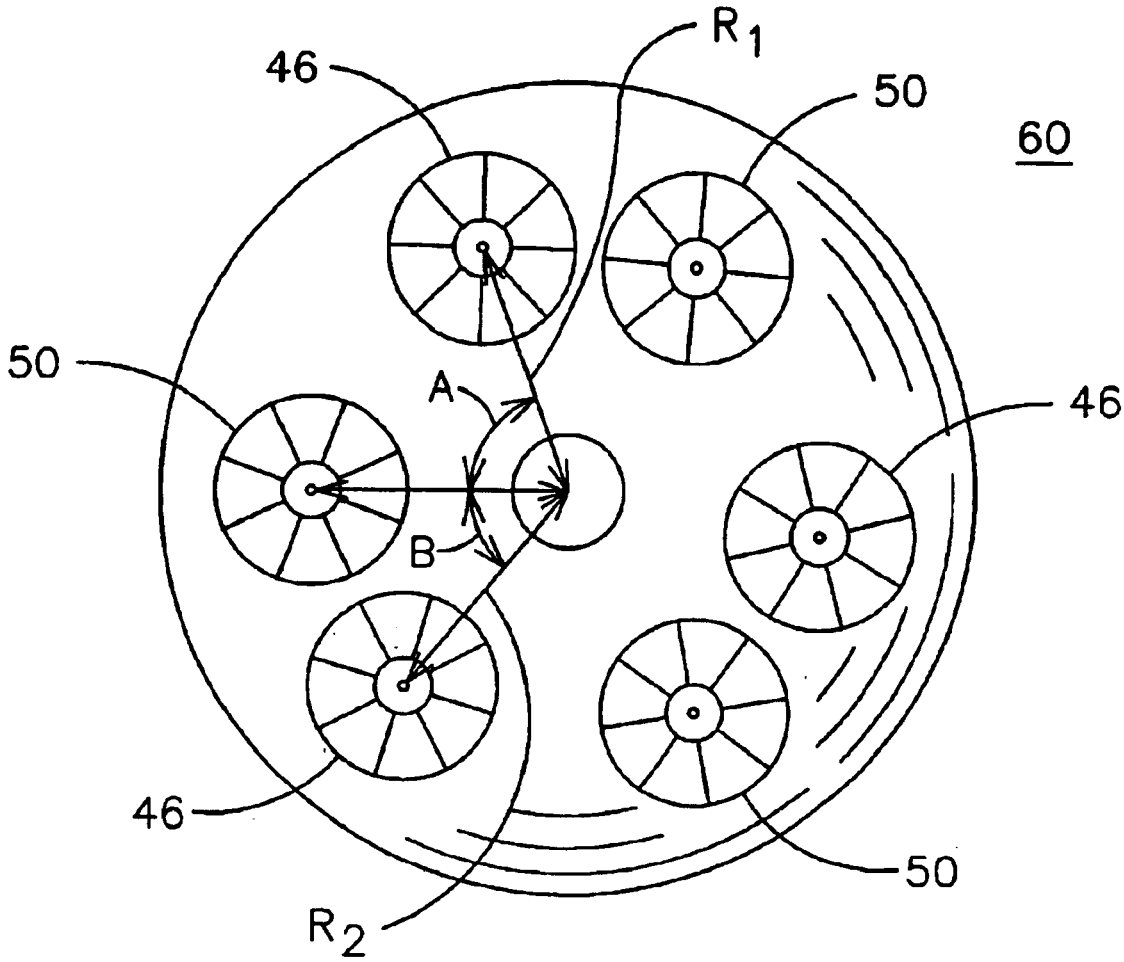
FIG. 4 is a sectional view of a further embodiment of a gas turbine engine having an improved annular combustor design.

A further degree of control may be developed in the can combustor 19 of FIG. 2 by providing an uneven clocking between the first and second stages 46, 50. As described above, in one embodiment the angular distance between neighboring nozzles may be a constant value of 360/2N degrees. For that example, angles A and B of FIG. 2 would be equal. However, by locating the second plurality of burners 50 at an angular location other than midway between respective burners 46, an angular displacement other than 360/2N degrees may be selected. For that example, angles A and B of the combustor 60 of FIG. 4 are unequal. The angle between adjacent burners may be 360/2N° plus or minus no more than 5 degrees or 360/2N° plus or minus no more than 10 degrees in two alternative embodiments. The combustion is still symmetric as long as all burners of a particular stage move by the same amount. Such uneven angular clocking will provide a degree of control that is responsive to the relative fuel flow rates provided to the two stages 46, 50. This effect can be used separately or it can be combined with the above-described effect of providing second stage burners 50 at a different radius than the first stage burners 46.

The can combustor 19 will behave differently when there is a change in the fuel bias between stages; i.e. providing X % fuel through first stage 46 and Y % fuel through second stage 50 will result in combustion conditions that are different than providing Y % fuel through first stage 46 and X % fuel through second stage 50. In prior art can combustors having two main fuel stages, each stage behaves the same as the other stage. By providing first and second stage burners 46, 50 having different radii $R_1$, $R_2$ and/or having asymmetric clocking there between, the two stages of the present invention will act differently to provide additional control possibilities for suppressing combustion dynamics. This improvement in control flexibility is provided without the necessity for providing an additional fuel stage.

The novel configurations described herein do not change the bulk firing temperature for any particular fuelling level when compared to a prior art can annular combustor. Rather, the aim is to create as many different modes of behavior as possible from a given number of fuel stages. For combustors that hold flame on the base plate 39, it is also possible to alter the flame holding zones on the base plate by fuel stage biasing in the can combustor 19 of FIG. 2.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

I claim as my invention:

1. A can combustor for a gas turbine engine comprising:

a first stage comprising a first plurality of burners arranged symmetrically around a longitudinal centerline of a combustion chamber at a first radial distance from the centerline; and a second stage comprising a second plurality of burners arranged symmetrically around the centerline of the combustion chamber at a second radial distance different than the first radial distance.

2. The can combustor of claim 1, wherein the burners of the second stage are angularly positioned midway between respective neighboring burners of the first stage.

3. The can combustor of claim 1, wherein the burners of the second stage are positioned at respective angular locations other than midway between respective neighboring burners of the first stage.

4. The can combustor of claim 3, wherein there are N burners in each of the first stage and the second stage, and further comprising an angular position between adjacent burners of 360/2N° plus or minus no more than 5 degrees.

5. The can combustor of claim 3, wherein there are N burners in each of the first stage and the second stage, and further comprising an angular position between adjacent burners of 360/2N° plus or minus no more than 10 degrees.

6. The can combustor of claim 1, further comprising the burners of the first plurality of burners each being disposed along a respective radius line, and the burners of the second plurality of burners each being disposed along a respective radius line that is not a radius line along which one of the first plurality of burners is disposed.

7. A can combustor for a gas turbine engine comprising:

a first stage comprising a first plurality of burners arranged symmetrically around a longitudinal centerline of a combustion chamber and angularly separated from each other by an angle of 360/N degrees;

a second stage comprising a second plurality of burners arranged symmetrically around the longitudinal centerline of the combustion chamber and angularly separated from each other by an angle of 360/N degrees;

wherein the burners of the second stage are positioned at respective angular locations other than midway between respective neighboring burners of the first stage.

8. The can combustor of claim 7, wherein there are N burners in each of the first stage and the second stage, and further comprising an angular position between adjacent burners of 360/2N° plus or minus no more than 5 degrees.

9. The can combustor of claim 7, wherein there are N burners in each of the first stage and the second stage, and further comprising an annular position between adjacent burners of 360/2N° plus or minus no more than 10 degrees.

10. The can combustor of claim 7, further comprising:

the first plurality of burners spaced from the longitudinal centerline at a first radial distance; and the second plurality of burners spaced from the longitudinal centerline at a second radial distance different than the first radial distance.

11. A gas turbine engine comprising:

a compressor for supplying compressed air;

a can annular combustor for burning fuel in the compressed air to produce a hot gas; and a turbine for expanding the hot gas;

wherein the can annular combustor further comprises a plurality of can combustors each comprising:

an annular member defining a combustion chamber having a longitudinal centerline;

a first plurality of burners fueled by a first fuel supply and disposed in a symmetrical ring around the centerline at a first radial distance; and a second plurality of burners fueled by a second fuel supply separately controllable from the first fuel supply, the second plurality of burners being disposed in a symmetrical ring around the centerline at a second radial distance greater than the first radial distance.

12. The gas turbine engine of claim 11, wherein the angular position of the second plurality of burners is selected so that the burners of the second plurality of burners are angularly centered between respective neighboring burners of the first plurality of burners.

13. The gas turbine engine of claim 11, wherein the angular position of the second plurality of burners is selected so that the burners of the second plurality of burners are not angularly centered between respective neighboring burners of the first plurality of burners.

14. The gas turbine engine of claim 13, wherein the angular position of the second plurality of burners is within 5 degrees of being angularly centered between respective neighboring burners of the first plurality of burners.

15. The gas turbine engine of claim 13, wherein the angular position of the second plurality of burners is within 10 degrees of being angularly centered between respective neighboring burners of the first plurality of burners.

16. The gas turbine engine of claim 11, wherein the symmetric rings of the first and second plurality of burners are arranged so that no burner of the first plurality of burners is located along a common line of radius with a burner of the second plurality of burners.

17. A gas turbine engine comprising:

a compressor for supplying compressed air;

a can annular combustor for burning fuel in the compressed air to produce a hot gas; and a turbine for expanding the hot gas;

wherein the can annular combustor further comprises a plurality of can combustors each comprising:

a first stage of burners disposed in a symmetrical circular pattern about a centerline, N being the number of burners in the first stage of burners and 360/N° being an angle of separation between burners of the first stage of burners;

a second stage of burners disposed in a symmetrical circular pattern about the centerline, the burners of the second stage of burners being singularly disposed between respective neighboring burners of the first stage of burners, N being the number of burners in the second stage of burners and 360/N° being an angle of separation between burners of the second stage of burners; and an angular separation between burners of the first stage of burners and neighboring burners of the second stage of burners being an angle not equal to 360/2N°.

18. The gas turbine engine of claim 17, further comprising:

the first stage of burners disposed in a circular pattern having a first radius about the centerline; and the second stage of burners disposed in a circular pattern having a second radius about the centerline not equal to the first radius.

* * * * *